United States Patent [19]

Lee

[11] Patent Number: 4,885,729

[45] Date of Patent: Dec. 5, 1989

[54] CLOCK MECHANISM AND DISPLAY FACE

[76] Inventor: Stephen M. Lee, 2024 Franklin Ave., E., Apt. 3F, Seattle, Wash. 98102

[21] Appl. No.: 228,532

[22] Filed: Aug. 4, 1988

[51] Int. Cl.[4] ..... G04B 19/04

[52] U.S. Cl. ..... 368/76; 368/80; 368/223

[58] Field of Search ..... 368/76, 80, 77, 220, 368/223, 228, 232, 233, 234

[56] References Cited

U.S. PATENT DOCUMENTS

| | | | |
|---|---|---|---|
| Re 309,306 | 12/1984 | Lindauer | 368/77 |
| 2,287,679 | 6/1941 | Greenawalt | 568/77 |
| 3,952,500 | 4/1976 | Tomura | 368/258 |
| 4,601,585 | 7/1986 | Farley | 368/80 |
| 4,712,924 | 12/1987 | Agostini | 368/76 |

*Primary Examiner*—Vit W. Miska

*Attorney, Agent, or Firm*—George M. Cole

[57] ABSTRACT

Clock mechanism and display face (10) having a quartz reverse movement electrical drive motor (24) with a pair of coaxial drive shafts (26, 28). The motor (24) is mounted on a supporting frame (12) and turns coaxially spaced apart drive gears (34, 41) for the hour and minute displays. The drive gears (34, 41) in turn mesh with and rotate driven gears (50, 52) and (60, 62) spaced either ninety degrees or one-hundred-eighty degrees from each other at their engagement points with their respective drive gears. Hour and minute display hands (100, 110) are mounted on posts on the driven gears which are located at the same point thereon. As the gears turn the intersection (109, 119) of the wires or the point (122, 124) of the ninety degree spacing describe a circle. The instersections or points overlay a dial face to indicate the time.

20 Claims, 5 Drawing Sheets

CLOCK MECHANISM AND DISPLAY FACE

DESCRIPTION

1. Technical Field

The invention relates to the field of clocks and more particularly to a clock with a novel and distinctive display face and drive mechanism.

2. Background Art

Among people skilled in the art of clock movements and particularly in new and aesthetic faces and dials for displaying time there are those who have wanted to design new ways for indicating time. For instance, designers have looked for a method other than conventional rotating hands but have not cared for digital clock faces because of the lack of esthetics in that type of display.

Accordingly, the inventor herein chose to use a linear method of showing time, as for instance by employing coordinates describing a circle instead of common rotating hands.

The only known prior art are U.S. Pat. Nos. 309,306; 2,287,679; 4,411,165; 4,646,073; and 4,712,924. None of these references, however, remotely relates to the principles and structure of the instant device. For example, the patented devices show a dial mechanism for a digital readout, an electronic coordinate readout for a computer screen and a watch for displaying a line on a dial.

DISCLOSURE OF THE INVENTION

The invention is a novel clock movement and dial display in which a mounting body is provided with a drive motor at the rear thereof with coaxial shafts extending forwardly. One shaft is solid and extends out to receive a minute hand display drive gear. The second hollow shaft mounts a drive gear for the hour hand display and is spaced axially inwardly of the minute drive gear. Each of the drive gears has two peripherally engaged driven gears which mesh with it at 180 or 90 degrees. Each of the pairs of driven gears supports an outwardly extending support post. A linear hand display means is mounted on each of the two posts for each hand display and allows for an almost endless variety of hand display configurations. The hand display can be straight intersecting wires in which the intersection describes a circle or the hand display may be a right angle member in which the point describes a circle. The minute and hour hand display members overlie a dial surface and are spaced from each other sufficiently to prevent their interfering with each other.

Accordingly it is among the many features of the invention to provide a clock movement and time display that is novel and aesthetic. The construction is simple but unique and enables the time display to be made with linear or curved hand display means. The rotational movement of the motor and drive gears is transferred to secondary driven gears where coincident points on pairs of gears are provided with support posts for the time hand display members. Thus a portion on the hand display overlying the dial face defines a circle as the matching pairs of driven gears rotate to indicate on the dial face the hour and minute of the time.

BEST MODE FOR CARRYING OUT THE INVENTION

Figure 1:
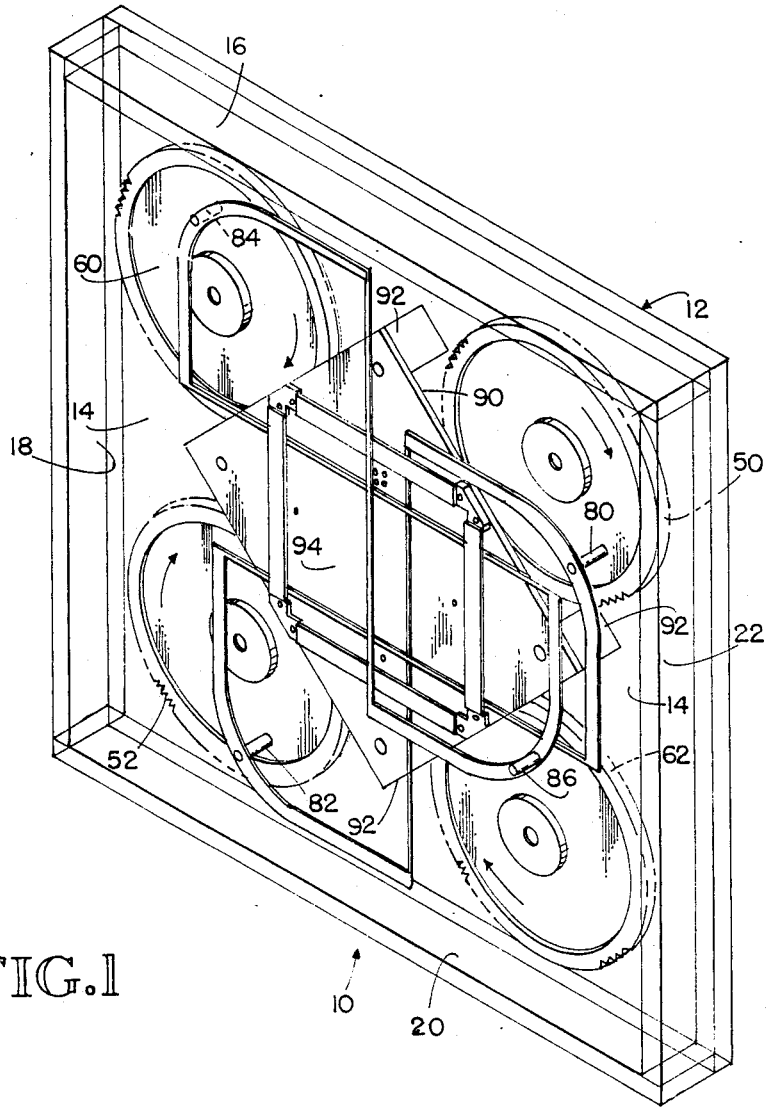
FIG. 1 is a view in perspective of the structural principles and operation of the invention.
Figure 2:
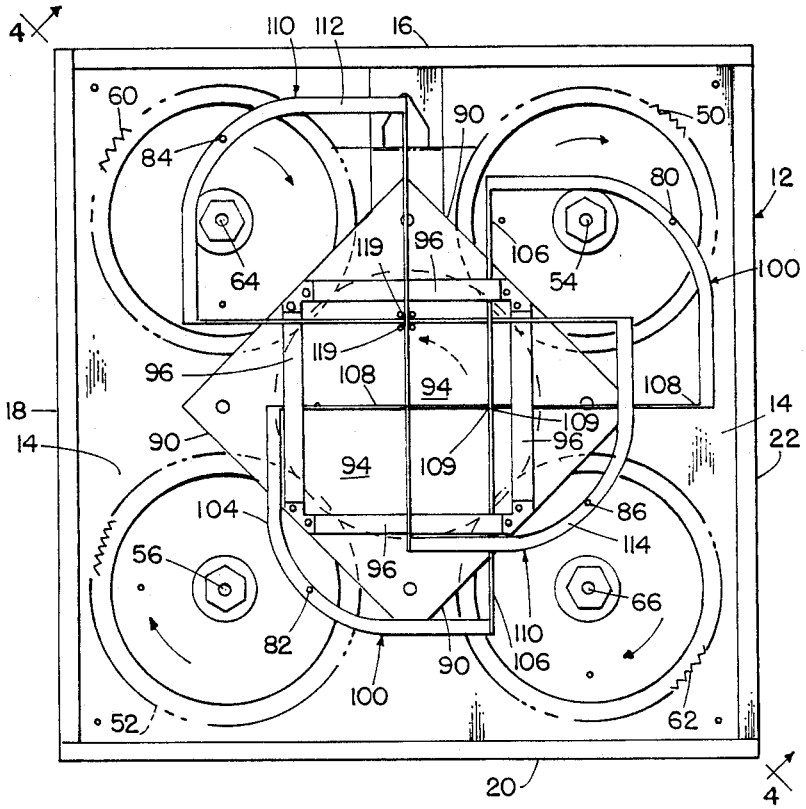
FIG. 2 is front plan view of the clock device of FIG. 1 and illustrates further details of construction.
Figure 3:
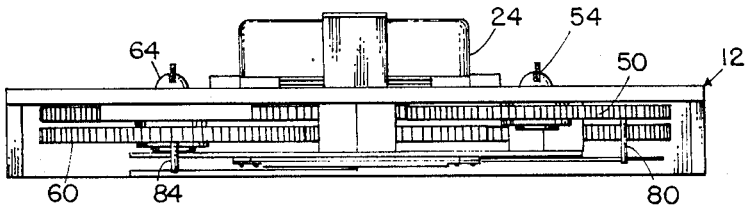
FIG. 3 is a top plan view of the clock device of FIG. 2.
Figure 4:
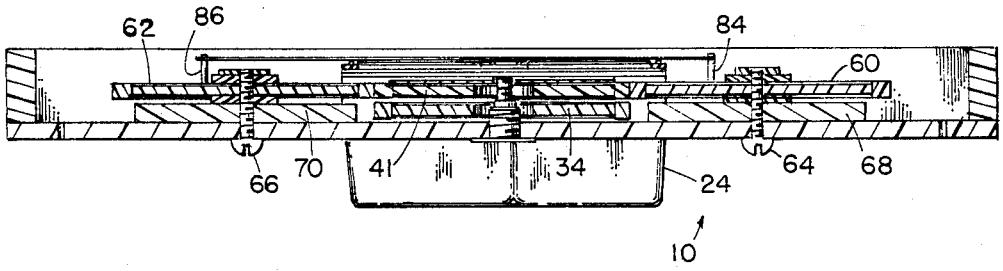
FIG. 4 is a cross section view along the line 4—4 of FIG. 2 showing additional details of the structure.
Figure 5:
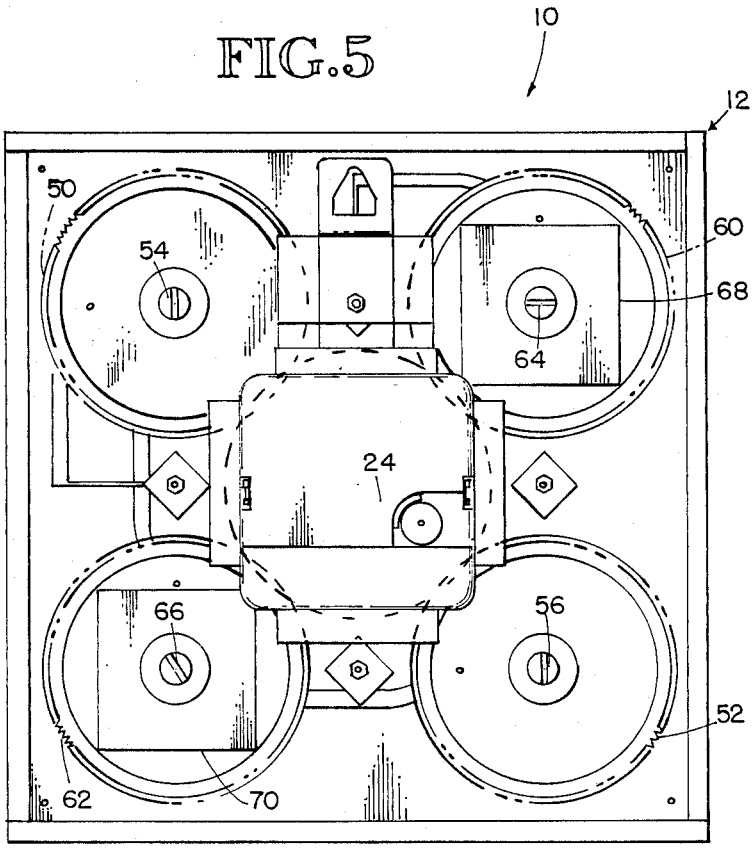
FIG. 5 is a rear plan view of the device of FIGS. 1 and 2.
Figure 6:
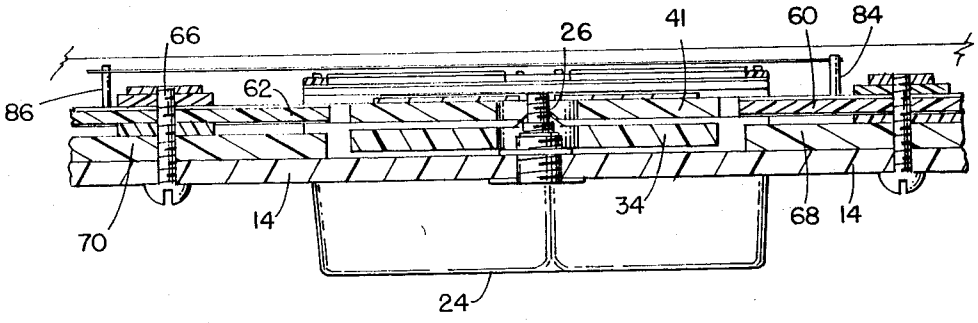
FIG. 6 is a partial cross section through the center of the clock device to further illustrate details of its structure.
Figure 7:
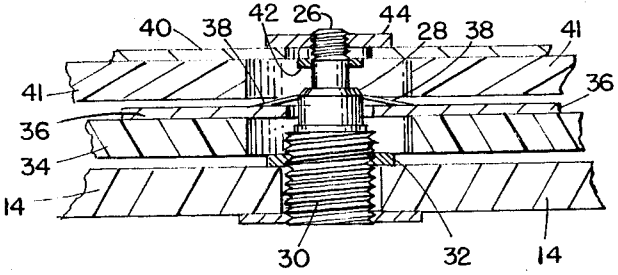
FIG. 7 is an enlarged partial cross section view to illustrate details of mounting the drive gears on the motor shafts.

Referring now to the drawings it will be seen by reference to FIGS. 1 through 6 it will be seen that the clock device of this invention is generally identified by the number 10 and includes a box-like frame generally reference to by the number 12. The frame includes a rear wall 14, and side walls 16, 18, 20 and 22. Detachably mounted on the rear wall 14 is a battery powdered electrical quartz reverse movement drive motor 24 having a pair of coaxial shafts extending through an opening in the rear wall 14. See particularly FIGS. 6 and 7 as showing that the coaxial shafts are the solid shaft 26 for driving the minute hand display and the coaxial hollow nylon shaft 28 for driving the hour hand display. The motor is secured to rear wall 14 by cylindrical threaded member 30 extending through the opening and thus permitting the nut 32 to cinch down from the opposite side of wall 14 and securely hold the motor in place.

The hollow hour hand shaft 28 receives a drive gear 34, made of nylon, which on its face away from the motor is provided with a metal mounting disc 36. At its center the metal disc 36 includes a plurality of prongs 38, in this case four, which dig into and make frictional contact with the outer surface of the hollow nylon shaft 28 to hold the drive gear 34 securely in position on the shaft.

A second drive gear 41 is coaxially mounted on the brass minute shaft 26 and also includes a mounting disc 40. The outer end of brass shaft 26 is threaded and includes a shoulder 42 against which metal disc 40 comes to rest. A nut 44 threads on to the shaft to secure the gear 41 in position. Thus the basic drive elements for the clock device are arranged as shown.

The hour drive gear 34 is engaged by two driven gears 50 and 52 which rotate on shaft means 54 and 56 respectively. In like manner minute hand drive gear 41 is engaged by a pair of driven gears 60 and 62 mounted on shaft means 64 and 66 respectively. Since driven gears 60 and 62 are mounted outwardly of the hour gears, spacer or raised sections 68 and 70 are provided on the inside of the frame to conveniently mount the driven gears 60 and 62 in proper planar alignment with their drive gear 41.

It will be seen that hour driven gears 50 and 52 are provided with upstanding display hand support posts 80 and 82 which are located at identical points on the outer faces of the gears. In like manner the minute hand driven gears 60 and 62 are provided with display hand support posts 84 and 86 respectively.

Covering the drive gears generally in the center of the frame 12 is a generally square face plate 90 supported in spaced relation to the inside surface of the rear wall 14 by four corner blocks 92. The face plate is shown to be disposed with the side edges at 45 degree angles since the corner blocks 92 occupy space not otherwise taken up by gears. A dial face 94 of a wide variety of dial designs is superimposed on the face plate to present the clock dial. Along the edges of the dial 94 are provided hand spacer strips 96 which are raised slightly off the face of the dial to provide a slot beneath the spacer strips.

Hand display 100 for the hour display includes an arcuate or bow member 102 mounted on support post 80 and an arcuate bow member 104 mounted on support post 82. Interconnecting the ends of the arcuate members 102 and 104 are linear thin wires 106 and 108 which have intersection 109 which comprises the indicator point for the hand display 100 and which travels in a circle. Similarly minute hand display 110 has arcuate bow members 112 and 114 carrying at their ends the cross wires 116 and 118 or other selected shapes as desired. The intersection or interconnecting point 119 of the cross wires provides the time indicator portion of the minute hand. It can be understood that the spacer strips 96 at the edge of the dial face 94 enable one hand display to move freely beneath the spacer strips and the other to move freely on the outside so that the hand displays do not engage or interfere with each other.

Figure 8:
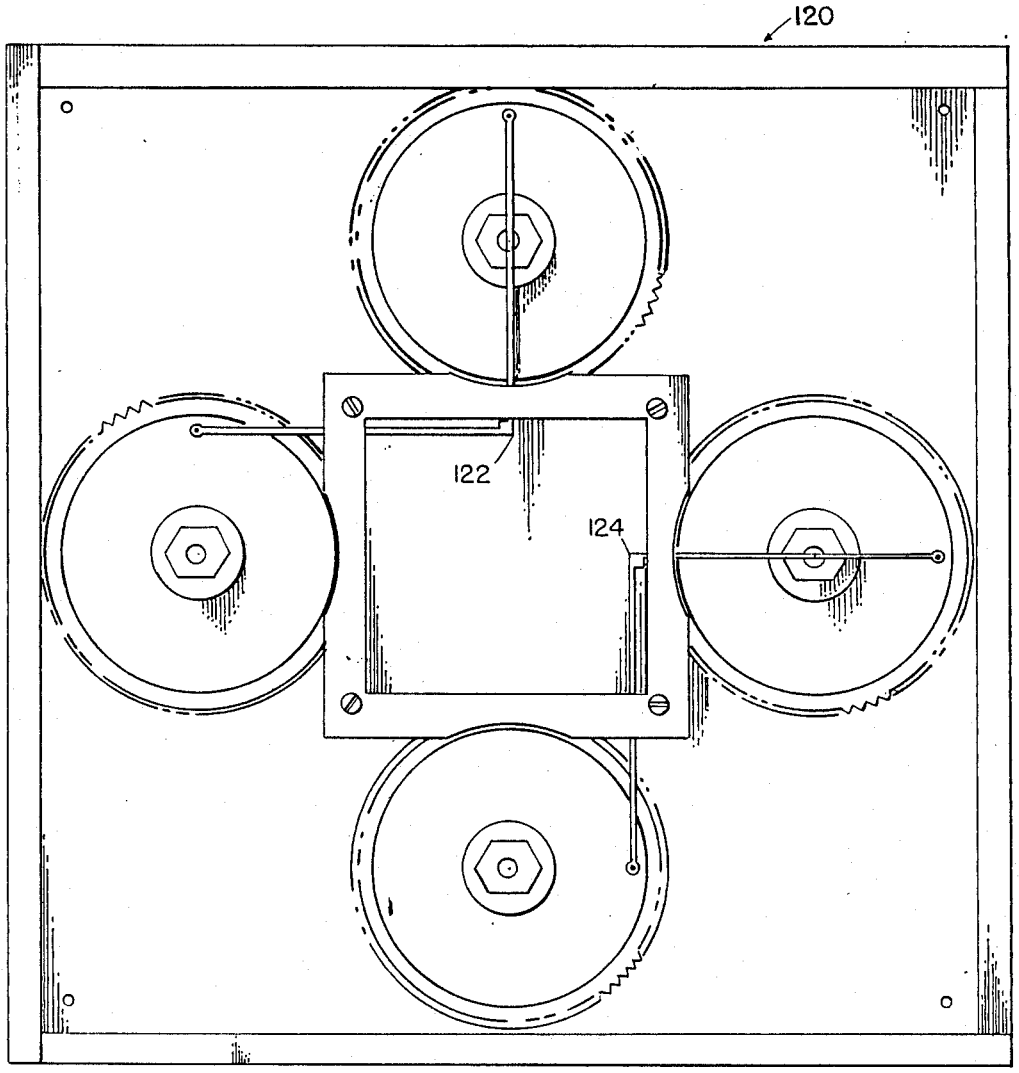
FIG. 8 is a front elevation view showing the driven gears at ninety degrees to each other so that the hand display means may take a different basic shape.

The embodiment of FIG. 8 shows that the driven gears instead of being spaced 180 degrees from each other in respect of their drive gear are adjacent each other at 90 degree and thus can have various types of hand displays at right angles with the corner or tips 122 and 124 as the indicators coming in from the periphery as opposed to crossing the dial face as indicated in the first embodiment.

I claim:

1. A clock, comprising:

(a) a support frame, (b) an electrical drive motor mounted on said frame with two coaxial shaft means including a first shaft on which is mounted a first drive gear for rotating at a first predetermined rotational speed and a second shaft on which is mounted a second drive gear axially spaced from said first drive gear for rotating at a second predetermined rotational speed, (c) a pair of first driven gears engaging said first drive gear and each having a first upstanding display hand support post thereon, said support posts pivotally supporting thereon first hand display means, said first hand display means having a first indicator portion which describes a circle as said first driven gears rotate, (d) a pair of second driven gears engaging said second driven gear and each having a second upstanding display hand support post thereon, said support posts pivotally supporting thereon second hand display means, said second hand display means having a second indicator portion which describes a circle as said second driven gears rotate, and (e) a dial face supported on said frame in spaced relation to said motor and said gears such that said first and second hand display means overly said dial face and said first and second indicator portions describe circles and wherein said first hand display means and its indicator portion represent the hour display and said second hand display means and its second indicator portion represent the minute display.

2. The clock according to claim 1 and in which said first and second hand display means are spaced from each other so as to prevent interference with each other as the first and second indicator portions move in their prescribed circular paths.

3. The clock according to claim 1 and wherein said first driven gears and said second driven gears engage their respective drive gears on opposed sides of their respective drive gears at substantially 180 degrees from each other.

4. The clock according to claim 1 and wherein said first driven gears and said second driven gears engage their respective drive gears at substantially 90 degrees from each other.

5. The clock according to claim 1 and in which a housing is secured to said frame and overlies said drive gears, said housing having a substantially flat outer surface on which is affixed said dial face.

6. The clock according to claim 1 and in which spacer means are attached generally around the edge portions of said dial face and disposed between said first and second hand display means so as to maintain non-interfering spacing between said hand display means.

7. The clock according to claim 2 and wherein said first driven gears and said second driven gears engage their respective drive gears on opposed sides of their respective drive gears at substantially 180 degrees from each other.

8. The clock according to claim 7 and wherein said first driven gears and said second driven gears engage their respective drive gears at substantially 90 degrees from each other.

9. The clock according to claim 8 and in which a housing is secured to said frame and overlies said drive gears, said housing having a substantially flat outer surface on which is affixed said dial face.

10. The clock according to claim 9 and in which spacer means are attached generally around the edge portions of said dial face and disposed between said first and second hand display means so as to maintain non-interfering spacing between said hand display means.

11. A clock, comprising:

(a) a support frame, (b) an electrical drive motor mounted on said frame with two coaxial shaft means including a first shaft on which is mounted a first drive gear for rotating at a first predetermined rotational speed and a second shaft on which is mounted a second drive gear axially spaced from said first drive gear for rotating at a second predetermined rotational speed, (c) a pair of first driven gears supported on said frame and engaging said first drive gear and each having a first upstanding display hand support post thereon, said support posts pivotally supporting thereon first hand display means, said first hand display means having a first indicator portion which describes a circle as said first driven gears rotate, said first support posts being positioned substantially at the same point on said first driven gears, (d) a pair of second driven gears supported on said frame and engaging said second drive gear and each having a second upstanding display hand support post thereon, said support posts pivotally supporting thereon second hand display means, said second hand display means having a second indicator portion which describes a circle as said second driven gears rotate, said second support posts being positioned substantially at the same point on said second driven gears, and (e) a dial face supported on said frame in spaced relation to said motor and said gears such that said first and second hand display means overly said dial face and said first and second indicator portions describe circles and wherein said first hand display means and its indicator portion represent the hour display and said second hand display means and its second indicator portion represent the minute display.

12. The clock according to claim 11 and in which said first and second hand display means are spaced from each other so as to prevent interference with each other as the first and second indicator portions move in their prescribed circular paths.

13. The clock according to claim 11 and wherein said first driven gears and said second driven gears engage their respective drive gears on opposed sides of their respective drive gears at substantially 180 degrees from each other.

14. The clock according to claim 11 and wherein said first driven gears and said second driven gears engage their respective drive gears at substantially 90 degrees from each other.

15. The clock according to claim 11 and in which a housing is secured to said frame and overlies said drive gears, said housing having a substantially flat outer surface on which is affixed said dial face.

16. The clock according to claim 11 and in which spacer means are attached generally around the edge portions of said dial face and disposed between said first and second hand display means so as to maintain non-interfering spacing between said hand display means.

17. The clock according to claim 12 and wherein said first driven gears and said second driven gears engage their respective drive gears on opposed sides of their respective drive gears at substantially 180 degrees from each other.

18. The clock according to claim 17 and wherein said first driven gears and said second driven gears engage their respective drive gears at substantially 90 degrees from each other.

19. The clock according to claim 18 and in which a housing is secured to said frame and overlies said drive gears, said housing having a substantially flat outer surface on which is affixed said dial face.

20. The clock according to claim 19 and in which spacer means are attached generally around the edge portions of said dial face and disposed between said first and second hand display means so as to maintain non-interfering spacing between said hand display means.

* * * * *